United States Patent [19]

Burke

[11] 4,325,689

[45] Apr. 20, 1982

[54] AUTOMATIC RESET CONTROL FOR DIRECT SPARK IGNITION SYSTEMS

[75] Inventor: James E. Burke, Indianapolis, Ind.

[73] Assignee: Harold A. Teschendorf, Indianapolis, Ind.

[21] Appl. No.: 134,969

[22] Filed: Mar. 28, 1980

[51] Int. Cl.[3] ..... H01M 2/40

[52] U.S. Cl. ..... 431/70; 431/27; 431/74

[58] Field of Search ..... 431/70, 71, 74, 27, 431/44, 80, 25

[56] References Cited

U.S. PATENT DOCUMENTS

| | | | |
|---|---|---|---|
| 3,446,565 | 5/1969 | Hantack | 431/70 |
| 3,529,910 | 9/1970 | Potts et al. | 431/70 |
| 3,582,249 | 6/1971 | Hodgson | 431/70 |

FOREIGN PATENT DOCUMENTS

| | | | |
|---|---|---|---|
| 1957920 | 6/1970 | Fed. Rep. of Germany | 431/70 |
| 2018972 | 10/1979 | United Kingdom | 431/70 |

*Primary Examiner*—James C. Yeung
*Attorney, Agent, or Firm*—Jenkins, Coffey, Hyland, Badger & Conard

[57] ABSTRACT

A fuel ignition system for a heating apparatus includes a burner connected to a fuel supply, a valve for regulating the flow of fuel to the burner, an electrode assembly for producing a spark to ignite the fuel at the burner, an ignition system control module having input and output terminals for controlling the operation of the valve and the electrode assembly in response to a temperature-actuated device, the system control module producing output signals to open the valve and activate the electrode assembly for a predetermined time period to ignite the burner and locking in a non-operable mode to close the valve and deactivate the electrode assembly if the burner fails to ignite within the predetermined time period, and an automatic reset control for activating the system control module after a time-delay period. The automatic reset control includes a timer for determining the time-delay period having an input terminal and an output terminal and a function control including two triggerable bidirectional switches for activating the system control module and for activating and deactivating the timer. A first bidirectional switch is triggered by an output signal produced by the system control module to activate the timer when the valve is closed and to deactivate the timer when the valve is open. A second bidirectional switch is triggered by an output signal produced by the timer to activate the system control module after the time-delay period.

19 Claims, 1 Drawing Figure

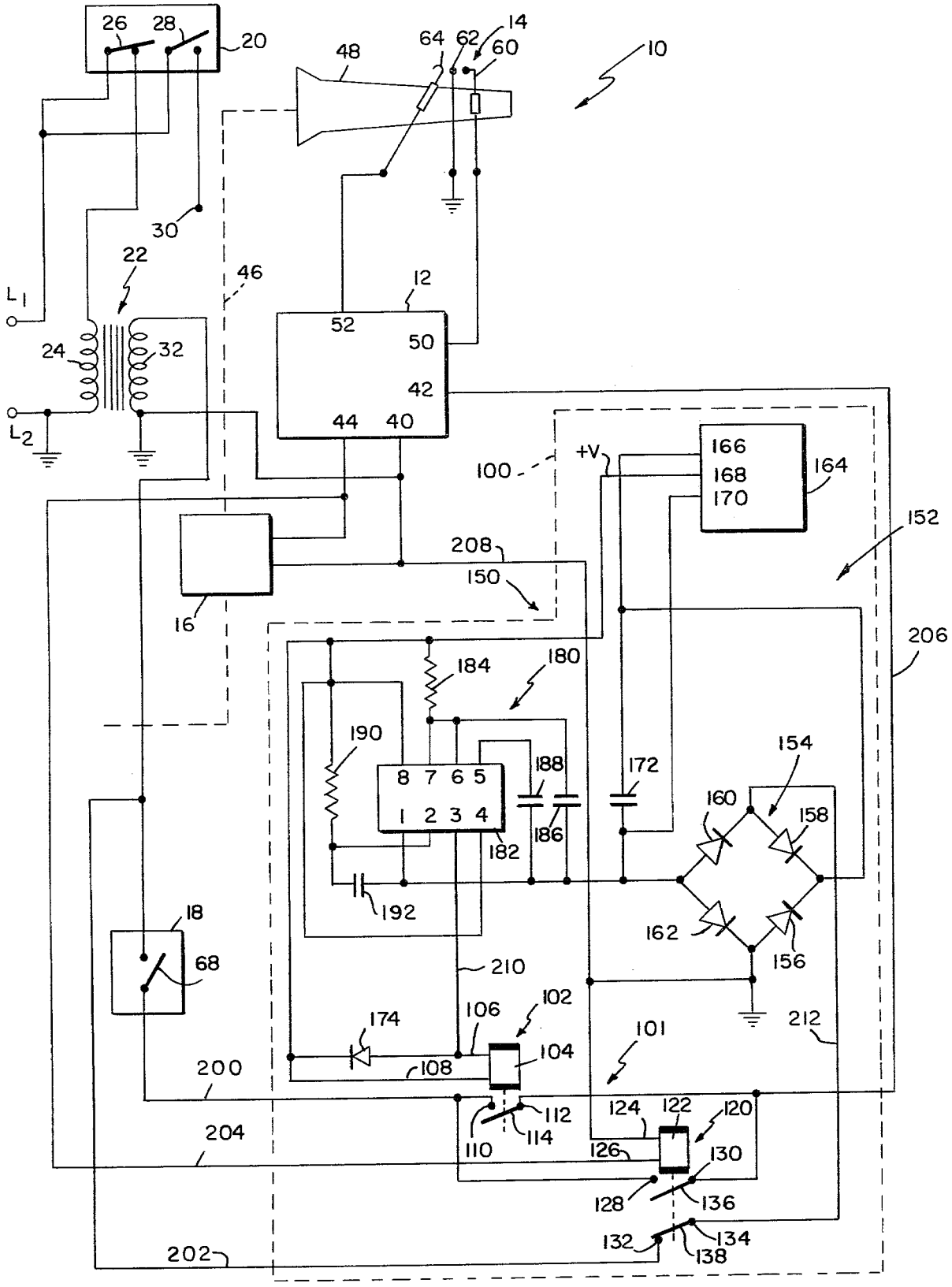
26
28
20
48
64
62
14
60
10
30
22
46
12
L1
52
50
24
32
42
L2
44
40
+V
166
168
170
164
100
152
208
150
16
206
184
180
190
188
172
154
8 7 6 5
1 2 3 4
160
158
182
186
192
18
162
68
156
210
174
106
102
212
101
104
200
108
112
124
122
120
204
110
114
126
130
128
136
132
134
138
202

AUTOMATIC RESET CONTROL FOR DIRECT SPARK IGNITION SYSTEMS

The present invention relates to direct spark ignition (DSI) systems for heating apparatus, such as a furnace, hot water heater, or appliance, for igniting a fuel upon demand for heat. More particularly, the present invention relates to a control for automatically resetting the DSI system if it fails to ignite the fuel within a prescribed time period.

With the increased need to conserve energy, many fuel-saving devices for fuel-burning heating apparatus have been developed. Exemplary of these fuel-saving devices is the direct spark ignition system now employed in many furnaces, hot water heaters, and dryers. Heretofore, furnaces, hot water heaters, and dryers have employed a continuously burning pilot to ignite a burner when heat is demanded. The pilot, therefore, burned even during those periods of time when there was no demand for heat, thereby wasting a substantial quantity of fuel. The DSI system controls the flow of fuel to the burner and ignites the burner when heat is demanded without requiring a continuously burning pilot.

Most of the present DSI systems include an ignition system control module for opening and closing a fuel valve and for activating and deactivating an ignitor located in proximity to the burner. When the demand for heat is indicated, the control module will open the fuel valve, thereby allowing fuel to flow to the burner and activate the ignitor to produce a spark to ignite the fuel at the burner. For purposes of safety, the control module opens the valve and activates the ignitor for only a limited predetermined time period. If the burner does not ignite within this predetermined time period, the control module locks the entire DSI system in a non-operable mode where the fuel valve is closed and the ignitor is deactivated. In most DSI systems, the control module can only be reset by discontinuing power to the control module and waiting approximately one minute or more before reapplying power thereto. Presently, the task of discontinuing and reapplying power to the control module must be accomplished manually. There are various reasons why the burner may fail to ignite within the limited predetermined time period, most of which are self-correcting so that when the control module is reset so that the fluid valve is again open and the ignitor again activated, the burner will ignite during a subsequent predetermined time period. However, unless the control module has been manually reset, the DSI system remains locked in a non-operable mode, and the system is given no more than one opportunity to ignite the burner.

Because the control module must be manually reset in order to cycle the fuel valve and ignitor through another trial ignition period, it is possible that, if no one is present to manually reset the control module, the heating apparatus will not operate when heat is demanded. Accordingly, serious damage may occur due to the lack of heat simply because no one was present to manually reset the control module.

It is, therefore, one object of the present invention to provide means for automatically resetting the ignition system control module when the burner fails to ignite within the limited, predetermined trial for ignition time period. According to the present invention, the ignition system control module is automatically reactivated after a time-delay period which is determined by the automatic reset means.

The automatic reset means of the present invention includes timing means for determining the time-delay period and function control means for activating the ignition system control module and for activating and deactivating the timing means.

Further, according to the present invention, the automatic reset means is a single unit which is capable of being installed on pre-existing DSI systems. For this purpose, the automatic reset means includes means for electrically coupling the function control means to a power supply source, to an input terminal of the timing means to activate the timing means, to a temperature-actuated device, to an input terminal of the ignition system control module, to an output terminal of the ignition system control module, and to an output terminal of the timing means. The function control means serves to activate the ignition system control module in response to an output signal produced by the timing means and a signal produced by the temperature-actuated device indicating a demand for heat and to deactivate the timing means in response to an output signal produced by the ignition system control module.

In a method of controlling a fuel ignition system of a heating apparatus which includes the steps of activating an ignition system control module in response to a temperature-actuated device, opening a valve for regulating the flow of fuel to a burner and activating an electrode assembly to produce a spark for a limited predetermined time period to ignite the burner, and deactivating the control module to close the valve and deactivate the electrode assembly if the burner fails to ignite within the predetermined time period, an improvement according to the present invention includes the steps of automatically reactivating the system control module after a time-delay period by activating a timing means when the valve is closed and the electrode assembly deactivated to determine the time-delay period, triggering a first bidirectional switch with an output signal produced by the timing means at the end of the time-delay period to activate the system control module, thereby opening the valve and activating the electrode assembly for a further limited predetermined time period, and triggering a second bidirectional switch with an output signal produced by the system control module when the valve is open and the electrode assembly activated to deactivate the timing means.

Various other features and advantages of the present invention will become apparent in view of the following detailed description of an embodiment thereof, which description should be considered in conjunction with the drawing which is a partly blocked schematic circuit diagram of an automatic reset control according to the present invention shown, for illustrative purposes, in a furnace DSI system.

While the present invention is illustrated and described in relation to a direct spark ignition (DSI) system in a furnace, it should be understood that the present invention may also be used in conjunction with DSI systems where fuel is burned to produce heat upon demand such as, for example, in hot water heaters and dryers. Accordingly, it is not intended that the present invention be limited to use in combination with any particular heating apparatus.

Referring now to the drawing, a typical DSI system 10 in a furnace or other heating apparatus includes three basic components. In particular, the DSI system 10 includes an ignition system control module 12 which includes an electronically controlled system for controlling the operation of the DSI system 10 and serves as a central wiring panel for other components of the DSI system 10. The DSI system 10 further includes an electrode assembly or ignitor 14 which is activated and deactivated by the ignition system control module 12 to produce a spark for ignition. The third component of the DSI system 10 is a redundant fuel valve 16 which includes a main valve and a redundant back-up valve which are opened and closed in response to the ignition system control module 12. Typically, the fuel is a natural or synthetic gas such as propane; however, the DSI systems are also operable with other ignitable fluid fuels.

A typical heating apparatus will also include a temperature-actuated device or thermostat 18 which produces a signal to indicate to the ignition system control module 12 that a demand for heat exists. Furthermore, the heating apparatus will include a motor/limit safety control 20 for activating and deactivating a motor (not shown) when the heat produced by the heating apparatus reaches predetermined levels and for deactivating the entire heating apparatus when the heat produced exceeds a predetermined safety level.

An AC power supply represented by supply lines L1, L2 of approximately one hundred fifteen volts AC is electrically connected to a step-down transformer 22 for reducing the voltage across the lines L1, L2 to approximately twenty-four volts AC. The transformer 22 includes a primary side 24 connected to the AC power supply lines L1, L2 through a normally closed-limit safety switch 26 of the control 20. The limit safety switch 26 is typically a temperature-actuated switch which opens when the temperature rises and exceeds a predetermined level. The AC power supply line L1 is also connected through a normally open switch 28 of the control 20 to a motor 30 (not shown) operating a fan, blower, etc. The switch 28 is also a temperature-actuated switch which closes when the temperature rises and reaches a predetermined level. The transformer 22 also includes a secondary side 32 which is coupled to the ignition system control module 12 through the thermostat 18 to power the ignition system control module 12 when the thermostat 18 indicates a demand for heat.

As illustrated in the drawing, the ignition system control module 12 includes a plurality of input and output terminals. Ground terminal 40 is electrically coupled to the ground of the secondary side 32 of transformer 22 and power input terminal 42 is electrically coupled through the thermostat 18 to the secondary side 32 of the transformer 22 to power the ignition system control module 12. An output terminal 44 is electrically coupled to the fuel valve 16 to regulate the flow of fuel through a fuel line 46 to the burner 48 of the heating apparatus. A further output terminal 50 is electrically coupled to the electrode assembly or ignitor 14 to provide an electrical potential of approximately sixteen thousand volts for spark ignition of the burner 48. A further input terminal 52 is also electrically coupled to the electrode assembly or ignitor 14 to receive a signal produced by the electrode assembly 14 indicating that a burner flame has been established.

The electrode assembly or ignitor 14 is positioned in proximity to the burner 48 and includes a spark electrode 60 positioned in exact spaced relationship to a ground electrode 62 to produce the spark for ignition of the burner 48 when an output signal is produced at terminal 50. The electrode assembly 14 also includes a flame sensor 64 which provides a signal to the input terminal 52 of the ignition system control module 12 to indicate that a burner flame has been established, thereby terminating the sparking. Furthermore, the flame sensor 64 monitors the burner flame throughout the heating cycle by continuously transmitting a signal to the input terminal 52 to provide protection against a flame-out where the burner flame is extinguished but the fuel valve remains open.

The thermostat 18 may include a conventional temperature-actuated switch 68 such as a magnetic or mercury bubble-type switch which closes when the temperature drops below a predetermined level and opens when the temperature exceeds another predetermined level.

In the conventional operation of the illustrated DSI system 10, power is supplied to the ignition system control module 12 across terminals 40, 42 when the temperature-actuated switch 68 closes indicating a demand for heat. The ignition system control module 12 in turn produces an output signal at terminal 44 which opens the valve 16 to allow the fuel to flow to the burner 48 and simultaneously produces an output signal at terminal 50 which activates the electrode assembly 14 to produce a spark for ignition of the burner 48 thereby initiating a predetermined trial for ignition time period. In general, the fuel valve 16 is open and the electrode assembly 14 activated for a predetermined trial for ignition time period of approximately 6.8 seconds. If the burner fails to ignite and a burner flame is not established within this predetermined trial for ignition time period, the ignition system control module 12 goes into a lock-out state, thereby rendering the DSI system 10 non-operable, closing the fuel valve 16, and deactivating the electrode assembly 14. This lock-out state serves as a safety feature of the DSI system 10 and the system 10 can only be reset by disconnecting power to the ignition system control module 12 and waiting for a time period of approximately one minute or more before manually reapplying power to the control module 12. If during the predetermined trial for ignition timer period, the burner is ignited and a burner flame is established, the flame sensor 64 sends a signal to input terminal 52 of the control module 12 which in turn deactivates the spark electrode 60 to terminate the sparking. The flame sensor 64 continues to monitor the flame for the remainder of the heat cycle, and the burner operation will continue until the demand for heat is satisfied and the temperature-actuated switch 68 opens.

If the flame should become extinguished during the heating cycle, the flame sensor 64 provides a signal to the control module 10, which again activates the spark electrode 60, in an attempt to re-establish the burner flame within the predetermined trail for ignition time period. If the burner flame cannot be re-established within the predetermined trial for ignition time period, the ignition system control module 12 will go into a lock-out state. It should be noted that a burner flame may not be established during a one-time-only, predetermined trial for ignition time period for any number of various reasons and that many of the reasons for the burner's failure to ignite are self-correcting in nature. Accordingly, if the DSI system 10 were provided with another predetermined trial for ignition time period, the burner 48 would probably ignite and a burner flame would be established. Unfortunately, existing DSI systems 10 must be manually reset in order to provide subsequent trial for ignition time periods; and therefore, the DSI systems 10 are not automatically given subsequent trial for ignition time periods within which to establish a burner flame.

According to the present invention, a means 100 is provided for automatically resetting the DSI system 10 by reactivating the system control module 12 after a time-delay period of approximately 4.5 to 5 minutes after the system control module 12 goes into a lock-out state. Accordingly, after the time-delay period of 4.5 to 5 minutes, a subsequent trial for ignition time period is automatically provided by the system control module 12 to allow the burner to ignite. The automatic reset control 100 of the present invention is a single unit which may be easily installed and connected to an existing DSI system 10 by making approximately five external electrical connections between the automatic reset control unit 100 and the existing DSI system 10.

Referring to the drawing, the automatic reset control 100 for a DSI system 10 includes a function control means 101 for activating the ignition system control module 12 of the DSI system 10 and for activating and deactivating various functional components of the reset control 100. The function control means 101 includes a triggerable bidirectional switch 102 which, in the illustrative embodiment, is an electromechanical device such as a relay 104 having electrical input terminals 106, 108; a pair of main terminals 110, 112; and a movable contact 114 which provides a normally open connection between the main terminals 110, 112. In response to a signal applied to one of the electrical input terminals 106, 108, a solenoid associated with the electromechanical relay 104 is triggered to move contact 114 and thereby close the connection between terminals 110, 112. While for illustrative purposes, an electromechanical, bidirectional switch 104 has been shown, it will be understood by those skilled in the art that an electronic triggerable bidirectional switch such as a triac could perform the same function as the electromechanical relay 104.

The function control means 101 further includes another triggerable bidirectional switch 120 which, again in the illustrative embodiment, is an electromechanical relay 122 having electrical input terminals 124, 126; a first pair of main terminals 128, 130; a second pair of main terminals 132, 134; and first and second movable contacts 136, 138 associated with main terminals 128, 130 and 132, 134, respectively. Contact 136 provides a normally open connection between main terminals 128, 130; and contact 138 provides a normally closed connection between terminals 132, 134. In response to a signal applied to one of the electrical input terminals 124, 126, a solenoid is triggered to simultaneously move the contacts 136, 138 and thereby close the connection between terminals 128, 130 and open the connection between terminals 132, 134. Again, it should be understood that an electronic triggerable bidirectional switch such as one or more triacs could perform the same function as the electromechanical relay 122.

The automatic reset control 100 further includes an electronic control circuit 150. The control circuit 150 is powered by a regulated DC power supply 152, which includes the secondary side 32 of transformer 22 and a full-wave rectifier 154 comprising a diode bridge circuit 156, 158, 160, 162 electrically coupled across the secondary side 32. The full-wave rectifier 154 is further electrically coupled to a twelve-volt voltage regulator 164 having an unregulated input terminal 166, a regulated output terminal 168, and a reference terminal 170. The voltage regulator 164 may comprise any conventional, three-terminal, positive twelve-volt regulator such as, for example, the LM 78/LM 140/LM 240 series of three terminal positive regulators manufactured by National Semiconductor Corporation. A capacitor 172 coupled between the unregulated input terminal 166 and the reference terminal 170 of the voltage regulator 164 filters the rectified signal and a positive DC voltage (+V) is supplied at the regulated output terminal 168 as the output of the DC power supply 152. The positive DC voltage (+V) is supplied to the relay 104, and a damper diode 174 is connected across the electrical input terminals 106, 108 of the relay 104. The positive DC voltage (+V) is also supplied to a timer 180 for determining a time-delay period before the reset control 100 reactivates the DSI system 10.

In the illustrative embodiment, the timer 180 includes a monolithic timing circuit 182 such as, for example, the MC 1555 timing circuit manufactured by Motorola Semiconductor Products, Inc., which is connected for monostable operation and which uses as its timing base an external timing network comprising a resistor 184 and a capacitor 186. The timing circuit 182 includes a ground or reference terminal 1, a trigger input terminal 2, an output terminal 3, a reset terminal 4, a control voltage terminal 5, a threshold terminal 6, a discharge terminal 7, and a power input terminal 8. The power input terminal 8 is electrically coupled to the positive DC voltage (+V) and the discharge terminal 7 is electrically coupled to the timing network comprising resistor 184 and capacitor 186 to discharge capacitor 186. The threshold terminal 6 is likewise electrically coupled to the timing network comprising resistor 184 and capacitor 186; the control voltage input 5 is electrically coupled through a capacitor 188 to the negative side of the rectifier 154; the reset input 4 is electrically coupled to the positive DC voltage (+V); the output terminal 3 is electrically coupled to one of the electrical inputs 106 of the relay 104 to trigger the relay 104 in response to an output signal produced by the timing circuit 182; and the trigger input terminal 2 is electrically coupled to a reset timing network comprising resistor 190 and capacitor 192. In operation, the output signal produced by the timing circuit 182 at output terminal 3 is high while capacitor 186 is charging. When the voltage stored across capacitor 186 reaches two-thirds of the positive DC voltage (+V), the capacitor 186 is discharged through discharge terminal 7 and the timing circuit 182 produces a low output signal at output terminal 3. The low output signal produced by the timing circuit 182 is employed to trigger the relay 104, and the time delay before the output signal changes from high to low is determined by the time constant associated with the resistor 184 and capacitor 186 timing network.

Continuing to refer to the drawing, the main terminal 110 of bidirectional switch 102 and the main terminal 128 of bidirectional switch 120 are electrically coupled to the temperature-acutated switch 68 by an external electrical conduit 200. The main terminal 132 of the bidirectional switch 120 is electrically coupled to the secondary side 32 of the transformer 22 by an external electrical conduit 202. The trigger input terminal 126 of the bidirectional switch 120 is electrically coupled to the output terminal 44 of the ignition system control module 12 by an external electrical conduit 204. The main terminal 112 of bidirectional switch 102 and the main terminal 130 of bidirectional switch 120 are electrically coupled to the power input terminal 42 of the ignition system control module 12 by an external electrical conduit 206. The various components of the automatic reset control unit 100 are electrically grounded by electrically coupling an input terminal 124 of the bidirectional switch 120 and the full-wave rectifier 154 to the ground of the secondary side 32 of transformer 22 by an external electrical conduit 208. As can therefore be seen in the drawing, the automatic reset control 100 may be electrically coupled to an existing DSI system 10 employing five external leads 200, 202, 204, 206, and 208.

Within the automatic reset control unit 100, the trigger input terminal 106 of bidirectional switch 102 is electrically coupled to the output terminal 3 of the timing circuit 182 by an internal electrical conduit 210 and is, therefore, responsive to the output signal produced by the timing circuit 182. Furthermore, the main terminal 134 of the bidirectional switch 120 is electrically coupled to the DC power supply 152 and more particularly to the full-wave rectifier 154 by an internal electrical conduit 212 to activate and deactivate the timing circuit 182 depending upon the open or closed state of the movable contact 138.

In the operation of automatic reset control 100, main terminals 132, 134 of bidirectional switch 120 are normally connected so that the timing circuit 182 is activated. Since the timing circuit 182 periodically produces a low output signal, the main terminals 110, 112 of the bidirectional switch 102 are periodically connected by contact 114 so that if the temperature-actuated switch 68 should close, indicating a demand for heat, the ignition system control module 12 is activated. Once the ignition system control module 12 is activated, the electrode assembly 14 is activated; and simultaneously, the fuel valve 16 is opened for a predetermined trial for ignition time period to ignite the burner 48. When the fuel valve 16 is open, the bidirectional switch 120 is triggered to open the connection between main terminals 132, 134 thereby deactivating the timing circuit 182 and opening the connection between main terminals 110, 112 of bidirectional switch 102. Further, the main terminals 128, 130 of bidirectional switch 120 are connected to continue to provide power to the ignition system control module 12. If the burner 48 fails to ignite within the trial for ignition time period, and the ignition system control module 12 therefore goes into a lock-out state whereby the electrode assembly 14 is deactivated and simultaneously the fuel valve 16 is closed, the bidirectional switch 120 is again triggered to return to its normal state where the main terminals 132, 134 are connected and the timing circuit 182 is again activated. After a time delay period determined by the resistor 184 and capacitor 186 timing network, the circuit 182 produces a low output signal which triggers the bidirectional switch 102 to close the connection between main terminals 110, 112 which thereby again applies power to the power input terminal 42 of the ignition system control module 12 to activate the control module 12 and provide another trial for ignition time period.

In the illustrative embodiment, the resistor 184 and capacitor 186 timing network of the timing circuit 182 provide a time-delay period of approximately 4.5 to 5 minutes before the timing circuit 182 produces a low output signal to trigger the bidirectional switch 102. However, it should be understood that, by changing the resistance and capacitance values of the resistor 184 and capacitor 186, respectively, the time-delay period can be changed for any particular application of the automatic reset control unit 100.

What is claimed is:

1. In a fuel ignition system for a heating apparatus including a burner connected to a fuel supply, a fuel regulating valve, an electrode assembly, and a system control module for operating the fuel regulating valve and electrode assembly, the system control module being activated in response to a heat demand switch to open the valve and produce a spark for ignition of the burner during a predetermined time period and deactivated if the burner fails to ignite within such time period, the improvement comprising: reset means for automatically reactivating the system control module when the burner fails to ignite within the predetermined time period to again open the valve and produce a spark for the predetermined time period in response to the heat demand switch, the reset means including timing means for determining a time-delay period between deactivation and reactivation of the system control module, and function control means for activating the timing means when the system control module is deactivated and for activating the system control module after the time-delay period in response to a signal produced by the timing means.

2. The improvement as recited in claim 1 further comprising means for electrically coupling the function control means to a power supply source and to an input terminal of the timing means.

3. The improvement as recited in claim 2 further comprising means for electrically coupling the function control means to the heat demand switch, to an input terminal of the system control module, to an output terminal of the system control module and to an output terminal of the timing means.

4. The improvement as recited in claim 3 wherein the function control means includes a first triggerable, bidirectional switch having a trigger input terminal connected to the means electrically coupling the function control means to the output terminal of the system control module and a pair of main terminals connected to the means electrically coupling the function control means to the power supply and to the input terminal of the timing means to activate and deactivate the timing means in response to the system control module.

5. The improvement as recited in claim 4 wherein the function control means includes a second triggerable, bidirectional switch having a trigger input terminal connected to the means electrically coupling the function control means to the output terminal of the timing means and a pair of main terminals connected to the means electrically coupling the function control means to the heat demand switch and to the input terminal of the system control module to activate the system control module in response to a demand for heat and the output signal produced by the timing means.

6. The improvement as recited in claim 5 wherein a first output signal produced by the system control module closes the fuel-regulating valve, the timing means being activated when the fuel-regulating valve is closed, a second output signal produced by the system control module opens the valve to supply fuel to the burner and triggers the first bidirectional switch to deactivate the timing means.

7. The improvement as recited in claim 6 wherein the timing means is a timing circuit including an RC timing network for determining the time-delay period and the output signal produced by the timing means is low to trigger the second bidirectional switch.

8. The improvement as recited in claim 7 wherein the first triggerable, bidirectional switch further has a second pair of main terminals connected to the means electrically coupling the function control means to the heat demand switch and to the input terminal of the system control module to by-pass the second triggerable, bidirectional switch when the first bidirectional switch is triggered in response to the second output signal produced by the system control module.

9. The improvement as recited in claim 8 wherein the first triggerable, bidirectional switch is electromechanical and includes at least two movable contacts, the first pair of main terminals being normally closed by a first contact, and the second pair of main terminals being normally open by a second contact.

10. The improvement as recited in claim 9 wherein the second triggerable, bidirectional switch is electromechanical and includes at least one movable contact, the main terminals being normally open by the contact.

11. A fuel ignition system for a heating apparatus comprising, in combination: a burner connected to a fuel supply, a valve for regulating the flow of fuel to the burner, an electrode assembly for producing a spark to ignite the fuel at the burner, a system control module having input and output terminals for controlling the operation of the valve and the electrode assembly in response to a demand for heat, the system control module producing output signals to open the valve and activate the electrode assembly for a predetermined time period to ignite the burner and latching in a non-operable mode to close the valve and deactivate the electrode assembly if the burner fails to ignite within the predetermined time period, and an automatic reset means for reactivating the system control module after a time-delay period, the automatic reset means including timing means for determining the time-delay period having an input terminal and an output terminal and function control means for activating the timing means when the system control module is in its non-operable mode, for activating the system control module in response to an output signal produced by the timing means after the time-delay period, and for deactivating the timing means in response to an output signal produced by the system control module.

12. The system as recited in claim 11 wherein the function control means includes a first triggerable, bidirectional switch for activating the timing means when the valve is closed and the output signal produced by the system control module to open the valve triggers the first bidirectional switch to deactivate the timing means.

13. The system as recited in claim 12 wherein the function control means includes a second triggerable, bidirectional switch and the timing means produces an output signal for triggering the second bidirectional switch to activate the system control module after the time-delay period.

14. The system as recited in claim 13 wherein the first and second bidirectional switches each includes a trigger input terminal and at least one pair of main terminals.

15. The system as recited in claim 14 wherein the automatic reset means further includes means for electrically coupling the trigger input terminal of the first bidirectional switch to an output terminal of the system control module and means for electrically coupling the main terminals of the first bidirectional switch to a power supply and to the input terminal of the timing means.

16. The system as recited in claim 15 wherein the automatic reset means further includes means for electrically coupling the trigger input terminal of the second bidirectional switch to the output terminal of the timing means and means for electrically coupling the main terminals of the second bidirectional switch to a heat demand switch and an input terminal of the system control module.

17. In a method of controlling a fuel ignition system of a heating apparatus including the steps of activating a system control module in response to a demand for heat, opening a valve for regulating the flow of fuel to a burner, activating an electrode assembly to produce a spark for a predetermined time period to ignite the burner, and deactivating the control module to close the valve and deactivate the electrode assembly if the burner fails to ignite within the predetermined time period, wherein the improvement comprises the steps of automatically reactivating the control module after a time-delay period by activating a timing means when the valve is closed and the electrode assembly deactivated to determine the time-delay period, triggering a first bidirectional switch with an output signal produced by the timing means at the end of the time-delay period to activate the control module thereby opening the valve and activating the electrode assembly for the predetermined time period, and triggering a second bidirectional switch with an output signal produced by the control module when the valve is open and the electrode assembly activated to deactivate the timing means.

18. In a fuel ignition system for a heating apparatus including a burner connected to a fuel supply, a fuel-regulating valve, an electrode assembly, and a system control module for operating the fuel-regulating valve and electrode assembly, the system control module having an input terminal and an output terminal, the system control module being activated in response to a heat demand switch to open the valve and produce a spark for ignition of the burner for a predetermined time period and deactivated if the burner fails to ignite during such time period, the improvement comprising: reset means for automatically reactivating the system control module when the burner fails to ignite within the predetermined time period, the reset means including a timing means for determining a time-delay period, the timing means having an input terminal and an output terminal, a first triggerable bidirectional switch having a trigger input terminal and a pair of main terminals, a second triggerable bidirectional switch having a trigger input terminal and a pair of main terminals, means for electrically coupling the main terminals of the first switch to a power supply source and the input terminal of the timing means, means for electrically coupling the main terminals of the second switch to the heat demand switch and to the input terminal of the system control module, means for electrically coupling the trigger input terminal of the first switch to the output terminal of the system control module to activate and deactivate the timing means in response to the control module, and means for electrically coupling the trigger input terminal of the second switch to the output terminal of the timing means to activate the system control module after the time-delay period in response to a demand for heat and the timing means.

19. A fuel ignition system for a heating apparatus comprising, in combination: a burner connected to a fuel supply, a valve for regulating the flow of fuel to the burner, an electrode assembly for producing a spark to ignite the fuel at the burner, a system control module having input and output terminals for controlling the operation of the valve and the electrode assembly in response to a demand for heat, the system control module producing output signals to open the valve and activate the electrode assembly for a predetermined time period to ignite the burner and latching in a non-operable mode to close the valve and deactivate the electrode assembly if the burner fails to ignite within the predetermined time period, and an automatic reset means for reactivating the system control module after a time-delay period, the automatic reset means including timing means for determining the time-delay period, a first triggerable switch for activating the timing means during the non-operable mode of the system control module and for deactivating the timing means in response to an output signal produced by the system control module, and a second triggerable switch for activating the system control module in reponse to the timing means after the time-delay period.

* * * * *